United States Patent [19]

Haynie

[11] 4,068,497

[45] Jan. 17, 1978

[54] CIRCULAR KNITTING MACHINE

[75] Inventor: George Roger Haynie, Laurens, S.C.

[73] Assignee: Milliken Research Corporation, Spartanburg, S.C.

[21] Appl. No.: 733,762

[22] Filed: Oct. 19, 1976

[51] Int. Cl.[2] ..... D04B 15/74

[52] U.S. Cl. ..... 66/50 B

[58] Field of Search ..... 66/50 B, 50 R, 25

[56] References Cited

U.S. PATENT DOCUMENTS

| | | | |
|---|---|---|---|
| 1,969,853 | 8/1934 | Page | 66/50 B |
| 2,726,525 | 12/1955 | Haddad | 66/50 B |
| 3,004,413 | 10/1961 | Felker | 66/50 B |
| 3,512,377 | 5/1970 | Widdowson et al. | 66/50 R X |
| 3,771,326 | 11/1973 | Farmer et al. | 66/50 R |
| 3,835,669 | 9/1974 | Findlay et al. | 66/50 R |
| 3,885,404 | 5/1975 | Zahradka et al. | 66/50 R |
| 3,898,818 | 8/1975 | Schmidt | 66/50 B |
| 3,916,646 | 11/1975 | Takigawa et al. | 66/50 R |

FOREIGN PATENT DOCUMENTS

| | | | |
|---|---|---|---|
| 42,861 | 10/1972 | Japan | 66/50 B |
| 1,149,661 | 4/1969 | United Kingdom | 66/50 B |

*Primary Examiner*—Wm. Carter Reynolds
*Attorney, Agent, or Firm*—Earle R. Marden; H. William Petry

[57] ABSTRACT

A circular knitting machine having a novel jack and presser arrangement to prevent the jack from engaging the cam track at certain pre-selected times to prevent the cylinder needles from knitting in order to provide an area in the fabric being knit which is distinct from the pattern of the fabric but has the same density to prevent curl of the fabric when cut in the area.

1 Claim, 6 Drawing Figures

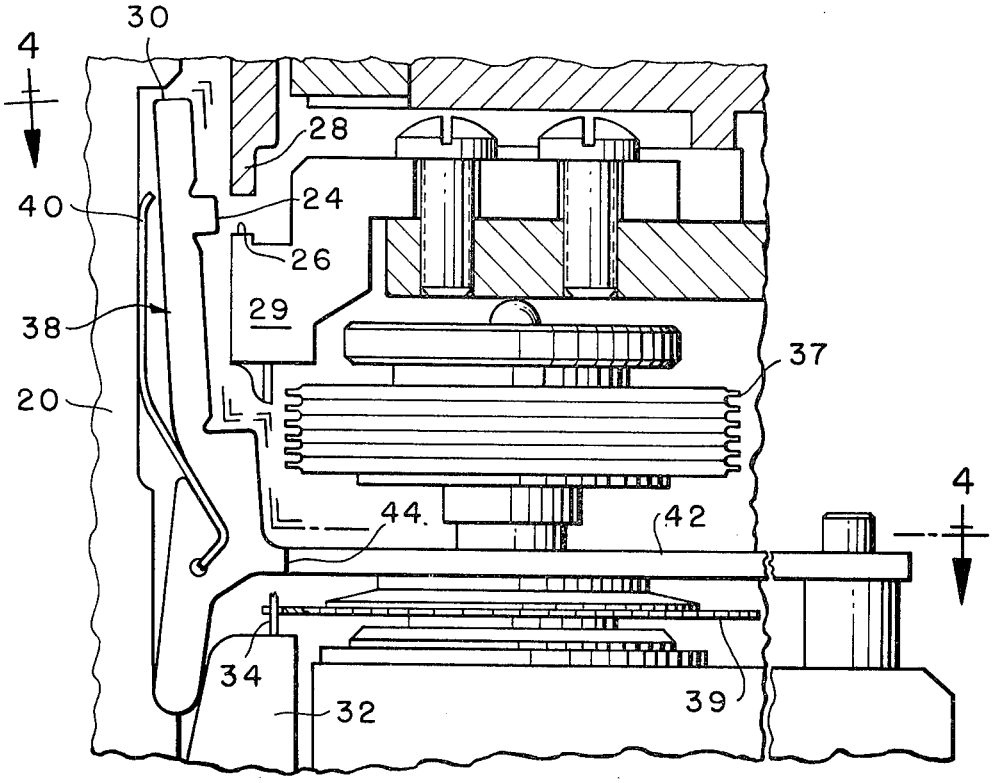
FIG.-3-
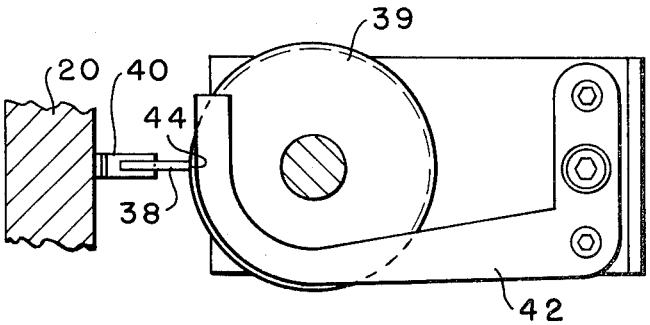
FIG.-4-
FIG.-6-
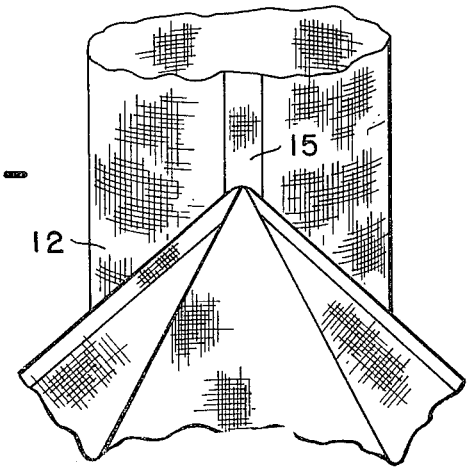

CIRCULAR KNITTING MACHINE

It is desired to produce a knit fabric in a circular knitting machine which has a continuous area, e.g., a stripe, of different visual characteristics than that of the body of the fabric to provide an area of the fabric which can be cut without sever curling of the edges.

It is therefore an object of the invention to provide a novel jack and a novel jack and presser arrangement for a circular knitting machine which will disengage the jack from the cylinder jack cam at certain pre-selected intervals or feeds.

Other objects and advantages of the invention will become clearly apparent as the specification proceeds to describe the invention, in which:

FIG. 3 is a view similar to FIG. 2 showing the improved modification thereof;

FIG. 4 is a view taken on line 4—4 of FIG 3;

FIG. 6 is a schematic view of the knit fabric made on the herein disclosed improvement in circular knitting machines.

Figure 1:
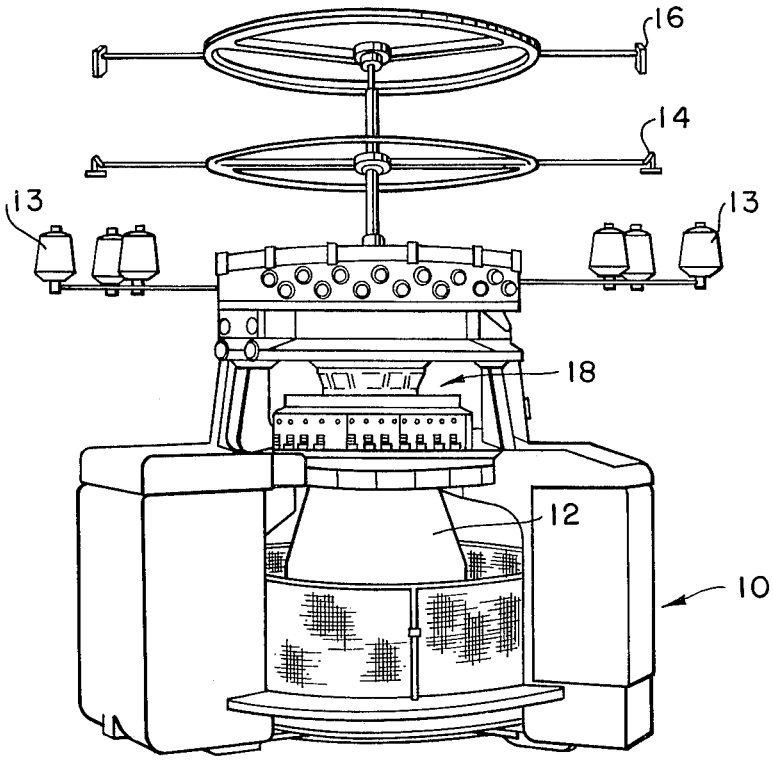
FIG. 1 is a schematic view of a typical circular knitting machine.

Looking now to FIG. 1, a typical circular knitting machine 10 is shown in perspective whereat a tubular knit fabric 12 is produced from a plurality of yarn feeds supplied with yarn from packages 13. The yarn from the packages 13 is supplied upward through the yarn guides 14 and stop motions 16 and then downward to the knitting section 18 of the machine. Typically, the knitting section 18 of the machine will consist of cylinder needles and dial needles which cooperate in a conventional manner to produce the knitted fabric 12.

Figure 2:
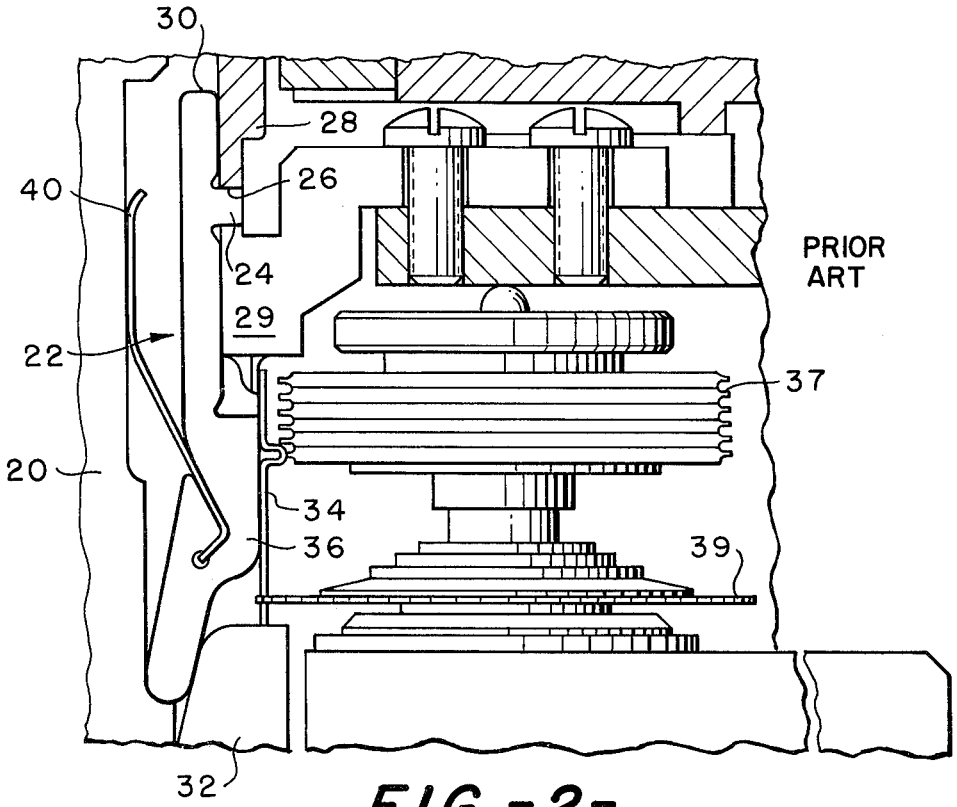
FIG. 2 is a partial section view of a conventional cylinder needle lower cam block and pattern mechanism.

FIG. 2 shows a conventional cylinder lower cam block and pattern mechanism defined by the trick bed 20 of the rotating needle cylinder which has a plurality of tricks or grooves therein to accommodate the spring loaded jack 22 to selectively raise the cylinder needles (not shown) into knitting position. The jack 22 is biased outwardly to place the butt portion 24 into engagement with the cam track 26 between the cam portions 28 and 29 so that the upper surface 30 of the jack 22 can raise and lower the cylinder needles (not shown) as the butt portion 24 follows the cam track as the trick bed 20 rotates.

Mounted in the spring block 32 are a plurality of control springs 34 which act on the butt portion 36 of the jack 22 to pivot the butt portion 24 out of and into operating relationship with the cam track 26. The position of the control springs and consequently the jacks 22 is controlled in conventional manner by the pattern discs 37 which are rotated in synchronism with the cylinder needles by the gear 39 which is engaged by a suitable gear (not shown) mounted on the rotating cylinder block.

As mentioned briefly before, it is desired to knit a longitudinal area, preferably a stripe 15 (FIG. 6) in the fabric being knit of different design than the rest of the fabric to guide the cutter when cutting open the tubular knit fabric prior to converting into a finished product. To this end it is desired to disable a pre-selected number of cylinder needles at a pre-determined number of feeds to the knitting machine. To accomplish this end, the basic machine of FIG. 2 is modified as indicated in FIGS. 3–5.

Figure 5:
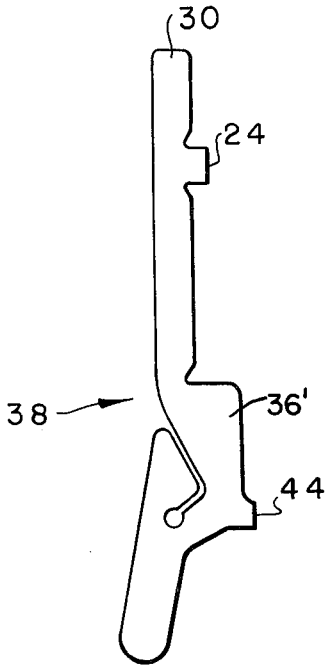
FIG. 5 is a vertical side view of a new improved cylinder needle jack.

Looking first to FIG. 5, a new jack 38 is substituted for the normal jack 22 at those positions in the cylinder where it is desired to move the jack 38 out of the normal knitting position for a pre-determined position of the trick bed 20 as it rotates. At those certain other feed positions of the knitting machine where it is desired to pivot the jack 38 against the bias of spring 40 to move the butt 24 out of the cam track 26, a presser 42 is mounted on the non-moving part of the machine adjacent the jack 38 to engage the butt portion 44 of the jack 38, as shown in FIG. 3, to prevent the butt 24 from engaging the cam track 26. To accomplish the above objective, the control spring 34 is cut off at those jack positions to allow the presser to engage the butt 44 of the jack 38 while at the remaining pre-selected jack positions the control spring will remain in engagement with the butt portion 36 of the jack 38.

As described briefly above, the new and improved jack 38 is only substituted in those positions in the trick bed 20 where necessary to knit the selvage stripe 15. Cooperating with this jack 38 at those desired positions is the presser 42 which has been added to engage the butt 44 when it is rotated into position opposite the presser. This allows the circular knitting machine to knit the selvage stripe 15 without removing the cylinder needles and provides a selvage stripe 15 of the same density as the body of the fabric so that when the circular knit fabric 12 is cut along the stripe 15, the tendency of the cut edges to curl is lessened considerably.

Although the preferred embodiment of the invention has been described specifically, it is contemplated that many changes may be made without departing from the scope or spirit of the invention and it is desired that the invention be limited only by the scope of the claims.

That which is claimed is:

1. A circular knitting machine including a tricked needle cylinder, individually operated knitting needles in said tricks, needle controlling jacks provided below and in the same tricks as said needles and a jack raising cam operably associated with said jacks, each of said jacks having a cam engaging first butt portion and a second butt portion, said knitting machine having a plurality of yarn feed positions, a pattern attachment mounted at each yarn feed position to control the position of needle controlling jacks at each of said feed positions, a presser mounted at certain selected yarn feed positions projecting towards said jacks, means mounting control springs at certain pre-selected jack positions in engagement with said second butt portions of said jacks, and jacks at certain other jack positions having a third butt portion projecting from said second butt portion engaging said presser when said needle cylinder is rotated to place said third butt portion opposite to said presser to pivot said first butt portion out of engagement with said jack raising cam.

* * * * *